US007448188B2

(12) United States Patent
Hauers et al.

(10) Patent No.: US 7,448,188 B2
(45) Date of Patent: Nov. 11, 2008

(54) CONTINUOUSLY OPERATING VERTICAL BAG FORMING FILLING AND SEALING MACHINE

(76) Inventors: Manfred Hauers, Alt-Breyeller Weg 21, D-41751 Vlersen (DE); Dieter Vits, Buchsbaumstr. 11, D-41470 Neuss (DE)

( * ) Notice: Subject to any disclaimer, the term of this patent is extended or adjusted under 35 U.S.C. 154(b) by 0 days.

(21) Appl. No.: 10/573,680

(22) PCT Filed: Sep. 21, 2004

(86) PCT No.: PCT/DE2004/002102

§ 371 (c)(1),
(2), (4) Date: Nov. 17, 2006

(87) PCT Pub. No.: WO2005/030588

PCT Pub. Date: Apr. 7, 2005

(65) Prior Publication Data

US 2007/0163214 A1 Jul. 19, 2007

(30) Foreign Application Priority Data

Sep. 24, 2003 (DE) ..... 103 44 116

(51) Int. Cl.
*B65B 9/06* (2006.01)
*B65B 9/20* (2006.01)
*B65B 51/30* (2006.01)

(52) U.S. Cl. ..... 53/551; 53/371.6; 53/374.6

(58) Field of Classification Search ..... 53/451, 53/551, 552, 371.3, 371.5, 371.6, 372.4, 53/374.3, 374.5, 374.6, 375.4
See application file for complete search history.

(56) References Cited

U.S. PATENT DOCUMENTS

| | | | | | |
|---|---|---|---|---|---|
| 4,004,398 | A | * | 1/1977 | Larsson et al. | 53/551 |
| 4,757,668 | A | * | 7/1988 | Klinkel et al. | 53/451 |
| 4,922,650 | A | * | 5/1990 | Akao et al. | 53/552 |
| 4,965,986 | A | * | 10/1990 | Klinkel | 53/551 |
| 5,241,804 | A | * | 9/1993 | Tsuruta et al. | 53/551 |
| 5,398,486 | A | * | 3/1995 | Kauss et al. | 53/551 |
| 5,505,040 | A | * | 4/1996 | Janssen et al. | 53/451 |
| 5,685,132 | A | * | 11/1997 | Romijn et al. | 53/551 |
| 5,832,701 | A | * | 11/1998 | Hauers et al. | 53/551 |
| 6,047,521 | A | * | 4/2000 | Terminella et al. | 53/552 |

FOREIGN PATENT DOCUMENTS

| | | | |
|---|---|---|---|
| DE | 19608522 | A1 * | 9/1997 |
| DE | 19918252 | A1 * | 10/2000 |
| EP | 1052170 | A2 * | 11/2000 |

* cited by examiner

*Primary Examiner*—Stephen F Gerrity
(74) *Attorney, Agent, or Firm*—Andrew Wilford

(57) ABSTRACT

A machine for forming a bag of a strip of weldable material, filling the bag with a fluent filling, and sealing the filled bag forms the strip into a longitudinally extending and laterally closed tube and continuously advances the tube longitudinally downward through a welding/folding station while pouring the filling into the tube above the station. A cross-seam welder and a folder at the station are both horizontally closable on opposite sides of the tube to form therein folds and a bag-forming crosswise weld. A vertically shiftable lifter is engageable under a filled section of the tube below the station. Simultaneously the welder and folder are closed on the tube to form a crosswise weld and to fold the tube horizontally inward while the filled section is raised and the welder and folder are moved downward generally synchronously while in contact with the downwardly moving tube.

13 Claims, 5 Drawing Sheets

CONTINUOUSLY OPERATING VERTICAL BAG FORMING FILLING AND SEALING MACHINE

CROSS REFERENCE TO RELATED APPLICATIONS

This application is the US national phase of PCT application PCT/DE2004/002102, filed 21 Sep. 2004, published 7 Apr. 2005 as WO 2005/030588, and claiming the priority of German patent application 10344116.6 itself filed 24 Sep. 2003, whose entire disclosures are herewith incorporated by reference.

FIELD OF THE INVENTION

The present invention is directed to a vertical bag forming, filling and sealing machine comprising a feed system for a wrapping material forming the tube bags, a filling tube around which the wrapping material is fed for the formation of a flexible tube and which serves for filling in a material that is to be packed into the tube, a drive means for the wrapping material, a longitudinal seam welding device, a cross-seam welding device for the formation of a cross weld seam at a tube bag, a lifting device for the filled tube bag not yet provided with an upper cross weld seam, and a folding device disposed below the cross-seam welding device and having two folding members for the wrapping material. The lifting device and the folding device are driven in such a controlled manner that, for folding the wrapping material onto the surface of the filling material, the filled tube bag is lifted relative to the folding device and the two folding members of the folding device are moved horizontally inward.

BACKGROUND OF THE INVENTION

A vertical bag forming, filling and sealing machine of the above-cited kind is known from EP-A-1052170. This known machine is a discontinuously operating machine according to which appropriate transport means cyclically move the wrapping material in the form of a flexible tube from above to below. Accordingly, especially during the inward movement of the weld jaws of the cross-seam welding device and the folding members of the folding device the wrapping material is not moved further on but is stopped so that the folding and welding steps can be carried out. Also in this position the filled tube bag is lifted relative to the folding device and the two folding members of the folding device are moved horizontally inward in order to press the wrapping material tightly against the upper surface of the filling.

The supplied wrapping material is pressed closely and tightly at the surface of the filling by the inward movement of the two folding members during the simultaneous lifting of the tube bag so that air present in this region of the tube bag is pressed out. Accordingly, no air cushion remains below the newly formed cross weld seam.

With this known vertical forming, filling and sealing machine good results are obtained. However, it is clear that this machine cannot produce large numbers of tube bags filled with filling per unit of time on account of its discontinuous operation.

OBJECT OF THE INVENTION

Accordingly, it is the object of the present invention to provide a vertical bag forming, filling and sealing machine of the cited kind that operates especially fast, however, enables a largely precise folding and welding of the wrapping material in the upper end portion of the tube bag.

SUMMARY OF THE INVENTION

According to the invention this object is achieved with a bag forming, filling and sealing machine of the cited kind by the features that the bag forming, filling and sealing machine is designed as machine with continuously moving flexible tube having a device for lowering the cross-seam welding device, folding device and lifting device synchronously with the downward movement of the tube, and that the inward movement of the weld jaws of the cross-seam welding device and the folding members of the folding device is controlled up to the respective end point such that nearly no relative movement between the weld jaws and the wrapping material takes place at the upper weld jaw contact point with the wrapping material whereupon the cross-seam welding device is lowered synchronously with the downward movement of the tube bag.

Accordingly, with the inventive tube bag forming, filling and sealing machine the wrapping material moves continuously downward along the filling tube not only during the preparing of the longitudinal weld seam but also during the folding and preparing of the cross weld seam, i.e. the wrapping material is not in a stationary position during the lifting process of the filled tube bag that is open at its upper side, the folding process and the preparing process of the cross weld seam but is continuously moved further on. A wrapping material drive means serves for the movement of the wrapping material that is preferably formed by one endless belt or a plurality of endless belts that laterally contact the wrapping material guided along the filling tube. The preparation of the longitudinal weld seam can Se realized during this continuous movement without any problems with an appropriate longitudinal seam welding device. Such longitudinal seam welding devices are known so that they have not to be described here in detail any more. The present invention is directed to the folding of the wrapping material onto the surface of the filling contained in the tube bag that is open at its upper side and the preparation of the cross weld seam during this continuous downward movement of the wrapping material. With the inventive solution one succeeds in folding (with lifting the tube bag that is open at its upper side and that is filled with the filling) the wrapping material onto the surface of the filling and preparing the cross weld seam without stopping the downwardly moving wrapping material so that the machine can be operated significantly faster than a corresponding discontinuously operating machine with which a corresponding stopping process is necessary.

According the invention the machine is designed in such a manner that nearly no relative movement between the weld jaws and the wrapping material takes place at the upper weld jaw contact point during the inward movement of the weld jaws of the cross-seam welding device and the folding members of the folding device up to the respective end point. This is obtained by synchronizing the downward movement of the wrapping material and the inward movement of the weld jaws and the folding members in a corresponding manner. Since the wrapping material is inwardly moved by the movement of the weld jaws during this period of time a relative movement between the jaws and the wrapping material can be nearly avoided whereby the danger of damaging the wrapping material by the inward movement of the weld jaws is excluded.

Accordingly, with the invention the continuous downward movement of the tube of the wrapping material is not to be affected by the folding and welding processes. Accordingly, with the invention the inward movement of the weld jaws and the folding members is synchronized with the movement of the wrapping material in such a manner that the weld jaws and the corresponding contact point of the wrapping material with the weld jaws move synchronously with respect to one another, i.e. nearly no relative movement between jaws and wrapping material takes place. The word "nearly" that is used here means that an exact synchronous inward movement between the tube of the wrapping material and the weld jaws is substantially impossible in practice so that the inventive teaching also includes corresponding deviations. According to the invention it is the intention to avoid in any case an injury of the continuous movement of the tube of the wrapping material by the welding and folding processes.

When the weld jaws and folding members have nearly reached their inner end point they are moved downward together with the lifting device synchronously with the downward movement of the wrapping material in order to not interrupt the continuous movement of the wrapping material. During this period of time the cross weld seam can be formed and the filled tube bag can be separated. During the following outward movement of the weld jaws and the folding members and the opening of the lifting device for discharging the finished tube bag the wrapping material continues to move downward so that even during these processes the continuous downward movement of the wrapping material is not interrupted. This is also the case for the following lifting of the cross-seam welding device, folding device and lifting device.

Preferably, according to the invention a single mover is provided that lowers the cross-seam welding device, folding device and lifting device synchronously with the downward movement of the wrapping material and again raises the same after the discharge of the finished tube bag packing. This single mover preferably includes a sliding unit that is movable along a rail laterally disposed from the tube axis. A slide drive means that is responsible for this movement can be controlled correspondingly in order to obtain the downward movement synchronously with the velocity of the wrapping material and a fast upward movement back into the original position.

Of course, this embodiment is not obligatory. According to the invention more than one mover can be provided either, for instance a mover for lowering the cross-seam welding device and folding device and a mover for lowering the lifting device.

If a single mover is provided, of course, the lifting device can lift the tube bag already filled with filling and open at its upper side and can lower the same again independently of the movement of this mover for the folding of the wrapping material. As mentioned above, this process takes place during the phase of the inward movement of the weld jaws and folding members, the single mover for lowering the cross-seam welding device, folding device being in its upper end position in this phase since no relative movement between the wrapping material and the weld jaws takes place on account of the inward movement of the wrapping material caused by the inwardly moving weld jaws. Only after the weld jaws and the folding members have nearly reached their inner end position the single mover begins to lower.

Accordingly, the inventive machine can have a single lowering device for the cross-seam welding device, folding device and lifting device or the lowering device can include separate means for lowering the cross-seam welding device and folding device on the one side and the lifting device on the other side.

Preferably, the lowering device is designed as slide movable along a vertical rail and carrying the cross-seam welding device, folding device and lifting device. If separate lowering devices are provided preferably the same are also formed by slides movable along vertical rails.

As mentioned above, the lifting device has to be able to lift the filled tube bag for folding and to lower it independently of the movement of the lowering device. It includes preferably a slide movable along a vertical rail that is provided at the lowering device. Accordingly, the slide of the lifting device can move along the associated vertical rail independently of the movement of the slide of the lowering device and its vertical rail. Preferably, the lifting device has two container halves open at the upper side or flaps that are supported at a cross beam supported by the slide of the lifting device and that are adapted to be pivoted into an open and closed position. By pivoting both container halves into an open position the filled tube bag contained therein can be downwardly discharged by the machine.

The cross-seam welding device can produce a single cross seam forming simultaneously the lower cross seam of the upper tube bag and the upper cross seam of the lower tube bag or can produce separately an upper and lower cross seam. In the last case it can have a welding device for preparing the upper cross weld seam and a welding device for preparing the lower cross weld seam. The folding device can be formed independently of the cross-seam welding device or can form a unit with the same or can be fixed to the cross-seam welding device. Furthermore, the cross-seam welding device itself can take over the function of the folding device so that in this case no separate folding device has to be provided. For instance, the folding device can be formed by the welding device for preparing the upper cross weld seam (with regard to the lower tube bag). In this case by the inward movement of the weld jaws of the welding device for preparing the upper cross weld seam simultaneously the wrapping material is folded onto the surface of the filling.

It is essential that with the present invention the process of lifting the already filled tube bag that is still open on the upper side for better folding the wrapping material onto the surface of the filling is realized with a continuously operating machine according to which the wrapping material moves continuously downward along the filling tube. This upward movement that is diametrically opposite to the movement of the wrapping material is carried out according to the invention during the phase in which the wrapping material is moved radially inward by the weld jaws so that in this manner the additional wrapping material that is necessary for the preparation of the cross weld seam is gained from the continuous downward movement of the same while the additional wrapping material necessary for folding the wrapping material onto the surface of the filling is gained by the lifting of the filled tube bag with the lifting device. Both processes have been combined according to the invention in such a tricky manner that the continuous movement of the wrapping material is not interrupted and in this manner high piece numbers of the machine are obtained.

For the assistance or improvement of the folding process the inventive tube bag forming, filling and sealing machine can have side folders that move in directions perpendicular with respect to the movement of the cross-seam welding device and folding device toward the wrapping material and away from the same and fold the wrapping material onto the surface of the filling from lateral direction.

The lift carried out by the lifting device has a value of approximately B/2, i.e. corresponds to approximately half of the width or thickness (dimension parallel to the movement of the weld jaws) of the formed tube bag.

As regards the start of the lowering movement of the cross-seam welding device, folding device and lifting device, this movement starts preferably shortly before the jaw contact, i.e. shortly before the end point of the inward movement of the weld jaws (end folding members), the movement being brought very fast to the velocity of the wrapping material. As mentioned above, the movement further on then takes place synchronously with the movement of the wrapping material.

BRIEF DESCRIPTION OF THE DRAWING

In the following the invention is described by means of an example in connection with the drawing in detail. Of the drawing

SPECIFIC DESCRIPTION

Figure 1:
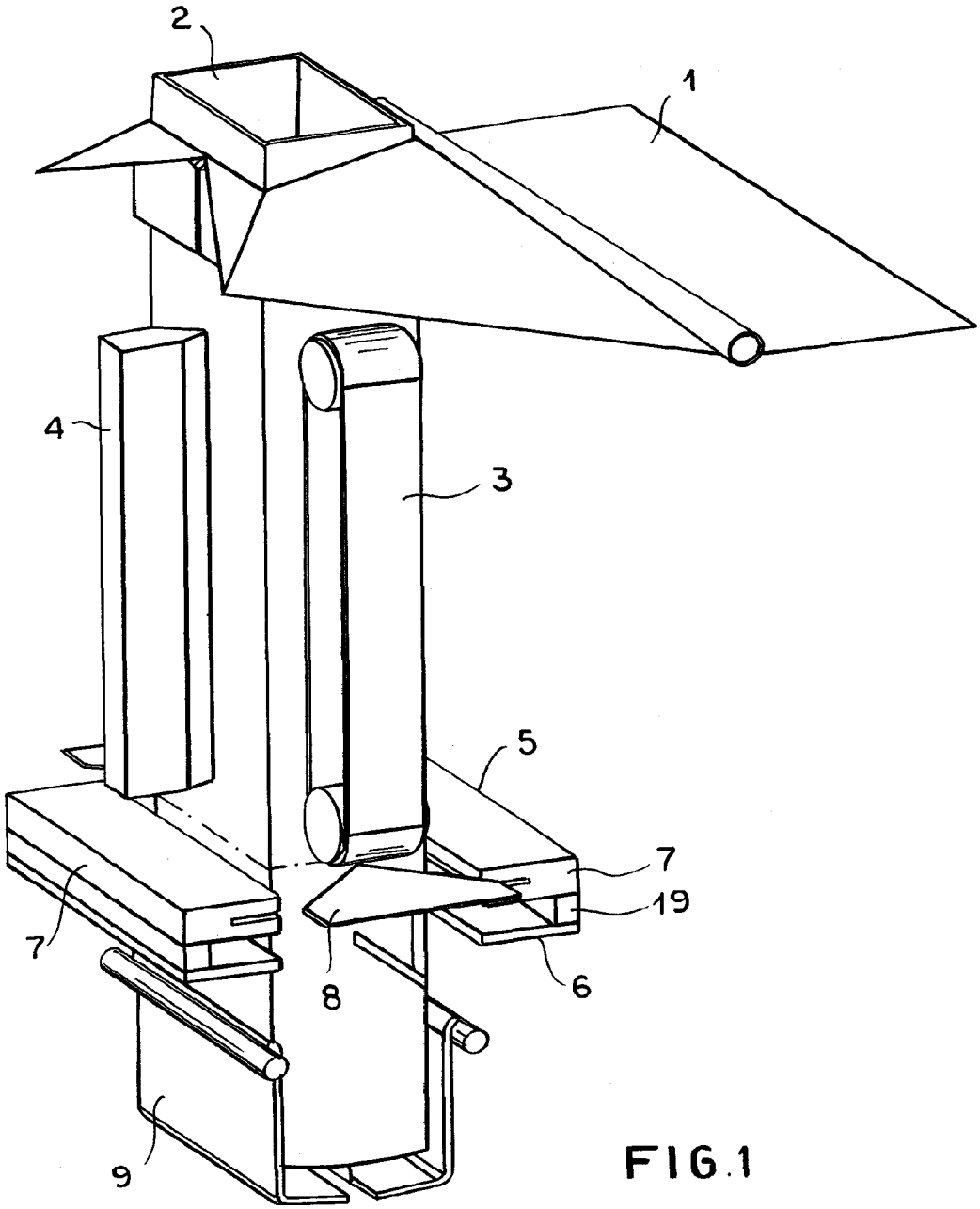
FIG. 1 shows a perspective view of the main parts of a vertical bag forming, filling and sealing machine where the jaws of the cross-seam welding device are shown while moving inward.

FIG. 1 shows the essential parts of a continuously operating vertical bag forming, filling and sealing device that are of interest for the present invention. An appropriate wrapping material 1, which for instance consists of polyethylene, is led around a rectangular filling tube 2 by means of a feed system (not shown) so that a flexible tube is formed. Appropriate transport means in the form of two vertically disposed endless belts 3 move the flexible tube continuously downward. During this movement a longitudinal seam welding device 4 welds together the longitudinal edges of the wrapping material 1.

At a slight distance from the lower end of the filling tube 2 a cross-seam welding device 5 is provided that serves for the formation of an upper cross weld seam for a lower tube bag and for the formation of a lower cross weld seam for an upper tube bag. On each side of the tube of the wrapping material the cross-seam welding device 5 has two vertically spaced weld jaws that serve for the formation of the upper and lower weld seams. The weld jaws for the formation of the upper cross weld seam also form a device 6 for folding the wrapping material onto the upper surface of the filling contained in the lower tube bag. These processes are described in detail below. Furthermore, the tube bag forming, filling and sealing machine shown in FIG. 1 includes a lifting device 9 that receives the lower tube bag filled with filling and lifts it in an upward direction opposite to the downward movement of the wrapping material. Finally, the machine includes side folders 8 that assist the folding process of the wrapping material from the side.

Figure 2:
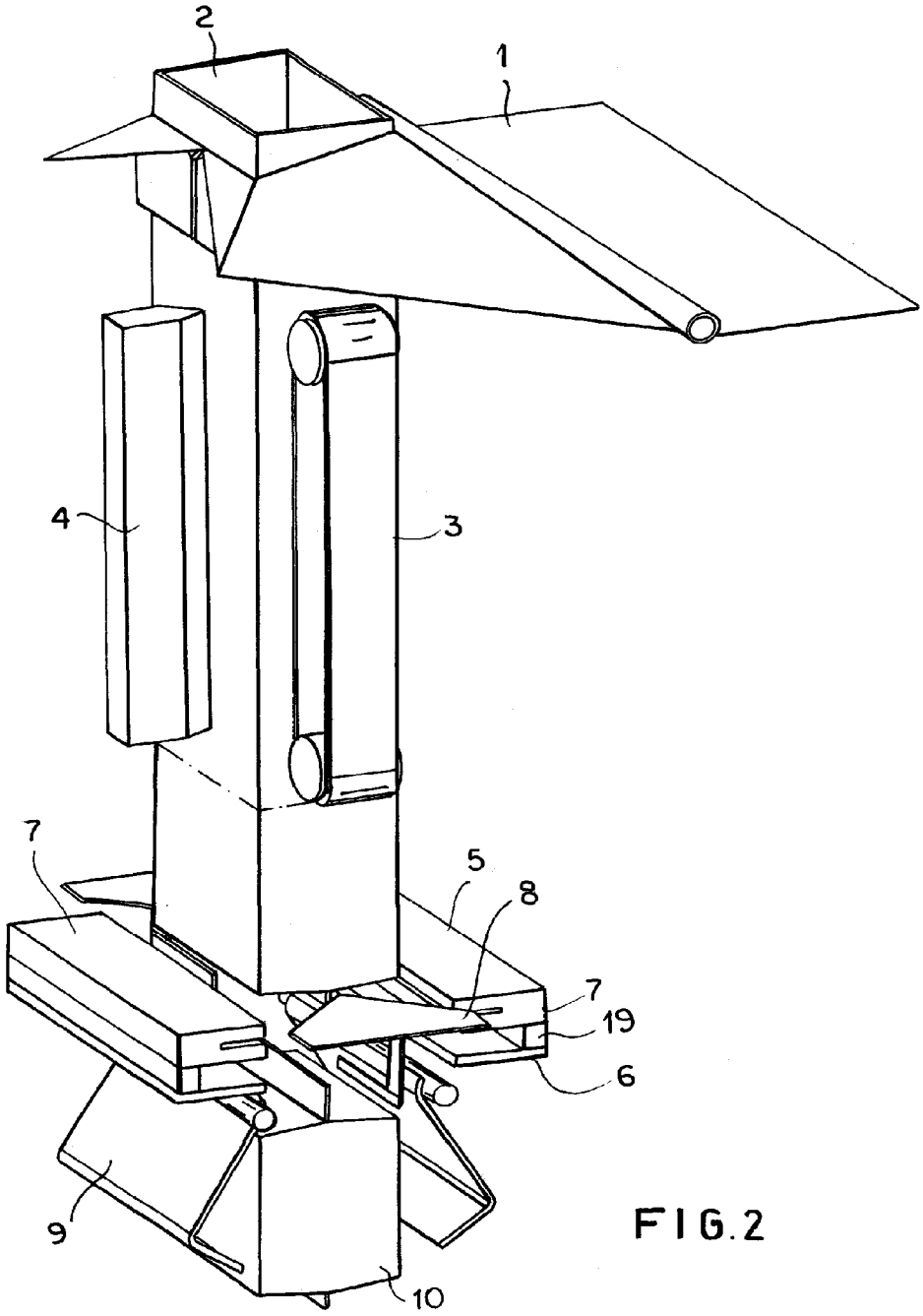
FIG. 2 shows a view like FIG. 1 where the jaws of the cross-seam welding device are shown in moving outward.

In FIG. 1 the machine is shown in a position in which the cross-seam welding device 5 and the folding device 6 are spaced from one another and the corresponding weld jaws or folding members are moving inward toward the wrapping material. FIG. 2 shows the machine after the folding and welding process by which time the weld jaws 7 and the folding members have moved again outward. In this position the two L-shaped flaps of the lifting device 9 have opened so that the finished tube bag packing 10 containing the filling drops down. During the folding, welding and lifting steps the tube of wrapping material 1 advances continuously downward as described in detail with reference to FIGS. 3 to 8.

Figure 3:
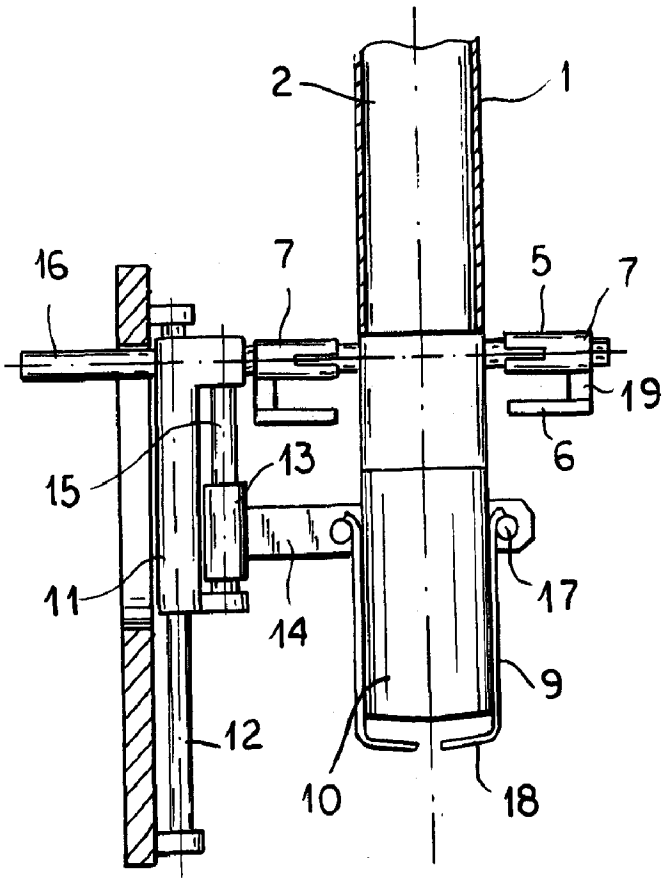
FIG. 3 shows a schematic vertical section through the machine of FIGS. 1 and 2 as the jaws of the cross-seam welding device assume their outer positions.

FIG. 3 shows the machine in a position in which the welding device 5 and the folding device 6 assume their outer radial end positions with their weld jaws 7 or folding members 6. In this position the wrapping material tube extends into the lifting device 9 and is continuously moved further downward into it while simultaneously filling is poured into the tube. FIG. 3 shows the position shortly after the end of the filling step. The two flaps 18 of the lifting device 9 are in the inwardly pivoted position, i.e. closed position.

As FIG. 3 further shows the weld jaws 7 and folding members partially movably supported on a first slide 11 that is vertically movable along a vertical rail 12. The movement of the first slide 11 is effected by means of an appropriate drive means (not shown). The guide rod of the weld jaws is shown at 16. The first slide 11 has an upper and a lower portion that protrude in FIG. 3 to the right and between which another vertical rail 15 is disposed. A second slide 13 is vertically movable along the rail 15. This second slide 13 has a cross beam 14 that supports the two flaps 18 that are pivotally supported by means of appropriate pivot means 17 at the cross beam 14. These parts form the lifting device 9 that lifts the lower tube bag filled with filling and fold the wrapping material onto the top surface of the mass of filling.

Figure 4:
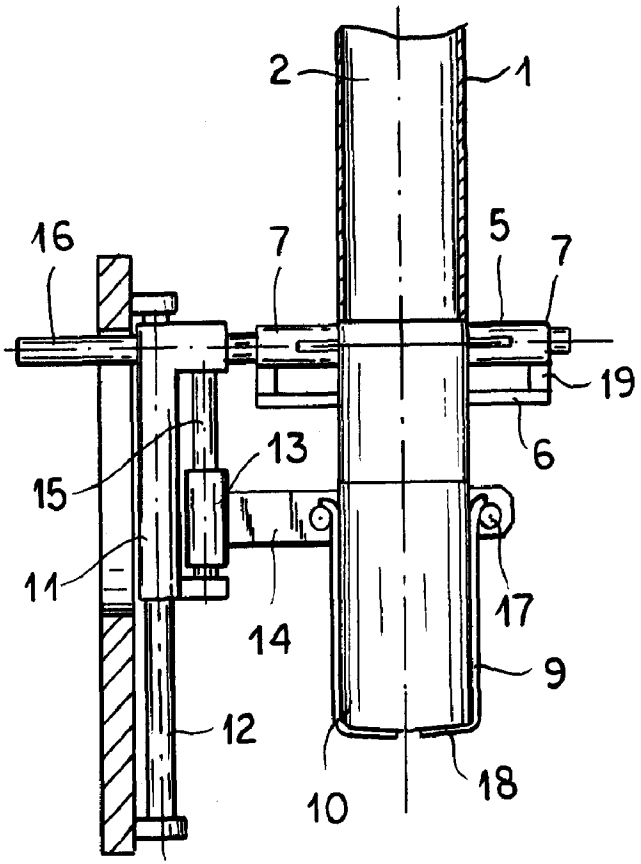
FIG. 4 shows a view like FIG. 3 where the weld jaws have approached the wrapping material.

FIG. 4 shows a position in which the weld jaws and folding members have moved further inward and already contact the wrapping material 1. The tube has moved further down into the lifting device 9 so that now it is supported by the horizontal portions of the L-shaped flaps 18. The first slide 11 is in its upper end position while the second slide 13 is in its lower end position.

Figure 5:
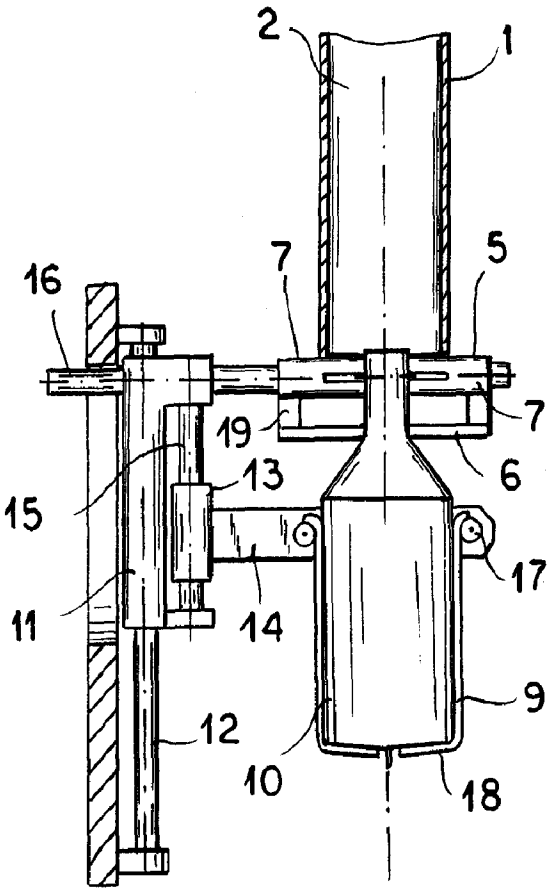
FIG. 5 shows a view like FIG. 3 where the weld jaws have been moved inward.

FIG. 5 shows a position in which the weld jaws and folding members have moved further inward. In this position the weld jaws have already pressed the wrapping material inward and in fact nearly no relative movement between wrapping material and weld jaws takes place since the wrapping material is advancing continuously. During this phase of the inward movement of the weld jaws and folding members the second slide 13 of the lifting device 9 has already moved slightly upward so that the folding or inward folding of the wrapping material onto the top surface of the filling can be carried out tension-free with regard to the supply of wrapping material.

Figure 6:
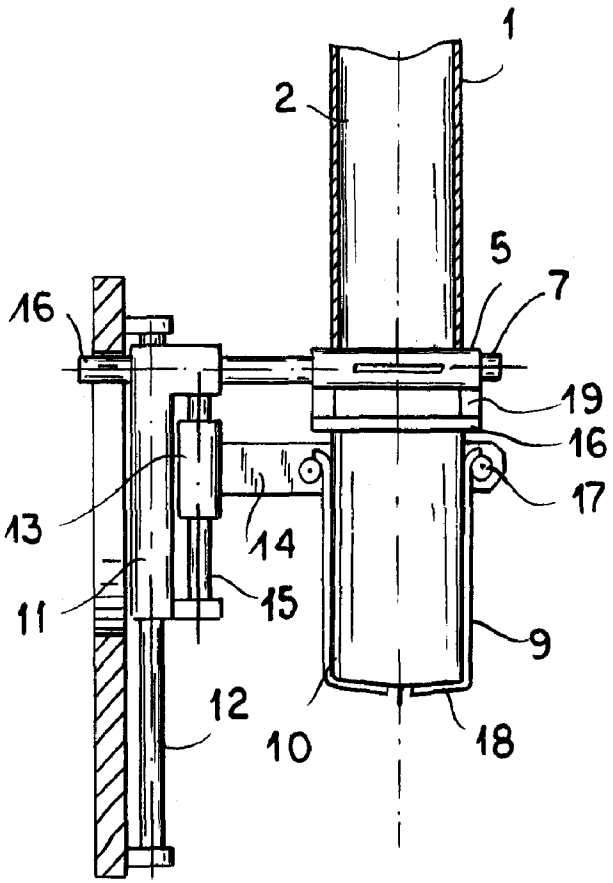
FIG. 6 shows a view like FIG. 3 where the weld jaws have reached their inner end positions and the folding process has been finished.

FIG. 6 shows when the weld jaws and folding members have reached their inner end positions. In this position the formation of the upper and lower cross weld seam is started. Shortly before reaching this position the first slide 11 begins its downward movement. This downward movement quickly reaches the same speed as the downward movement of the wrapping material so that the first slide 11 and the wrapping material move downward synchronously. In the meantime the lifting device 9 has lifted the filled tube up to the upper end position of the lifting device 9. All the air from the space above the filling has been forced out by the inward movement of the folding members and the wrapping material has been folded inward onto the upper surface of the wrapping material.

Figure 7:
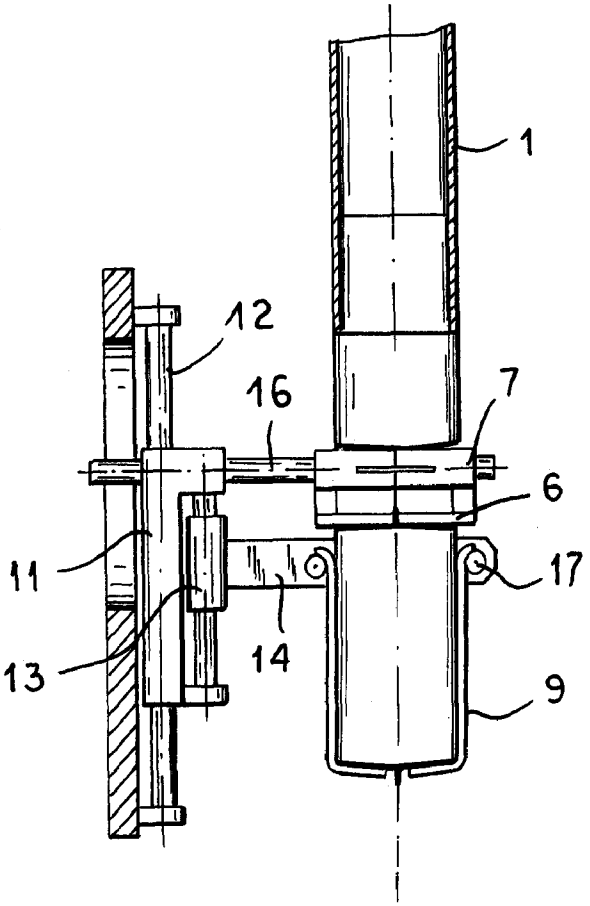
FIG. 7 shows a view like FIG. 3 where the lowering device for the cross-seam welding device, folding device and lifting device has moved downward.

FIG. 7 shows the position during the downward movement of the first slide 11 synchronously with the downward movement of the wrapping material. The second slide 13 of the lifting device 9 maintains its upper end position. During this phase both cross weld seams can be formed.

Figure 8:
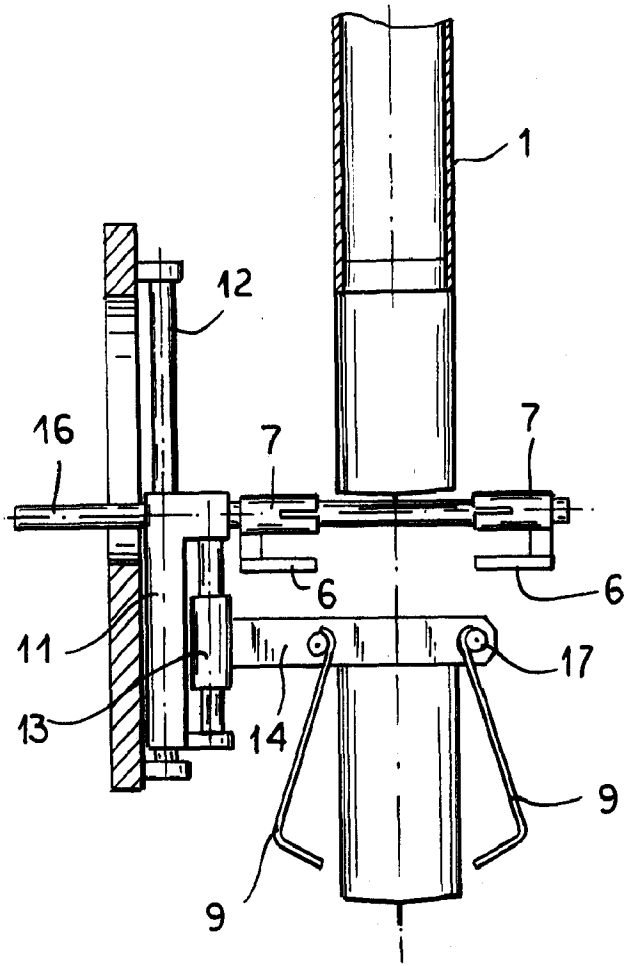
FIG. 8 shows a view like FIG. 3 where the lowering device has reached its lower end position.

In the position shown in FIG. 8 the first slide 11 is in its lower end position. The weld jaws and folding members have already moved apart, the second slide 13 of the lifting device is moving again back into its lower starting position, and the two flaps 18 have been pivoted outward in order to downwardly discharge the finished tube bag filled with filling 10. Thereafter, the first slide 11 moves up again, and the flaps 18 close again, and the slide 11 gets back to its upper starting position shown in FIG. 3. Now, the next cross weld seams can be made.

The folding device 6 is fixed to the cross-seam welding device 5 by means of height-adjusting elements 19 shown in FIGS. 1 and 2. These height-adjusting elements 19 enable a height adjustment of the folding device or an adjustment of the distance of it from the welding device 5. If the folding device 6 is formed by a lower welding device or is fixed on such a welding device a height adjustment of the lower welding device or an adjustment of its distance from the upper welding device is obtained. In this manner the folding device or the lower welding device can be adapted to the height of the level of the filling.

The side folder 8 shown in FIGS. 1 and 2 has an upper and a lower side folder element. The lower side folder element is mounted relative to the upper side folder element in a height adjustable manner is the folding device 6.

Of course, the side folders 8 are lowered and lifted together with the welding device 5, folding device 6 and lifting device 9.

The invention claimed is:

1. A machine for forming a bag of a strip of weldable material, filling the bag with a fluent filling, and sealing the filled bag, the machine comprising:

means for forming the strip into a longitudinally extending and laterally closed tube and continuously advancing the tube longitudinally downward through a welding/folding station;

means for pouring the filling into the tube above the station;

a cross-seam welder at the station and horizontally closable on opposite sides of the tube to form therein a bag-forming crosswise weld;

a folder at the station below the welder and horizontally closable on the tube to fold it inward;

a vertically shiftable lifter below the station engageable under a filled section of the tube below the station; and drive/control means connected to the welder, folder, and lifter for simultaneously closing the welder and folder on the tube to form a crosswise weld and to fold the tube horizontally inward while raising the filled section of the tube below the station relative to the welder and folder while displacing the welder and folder downward generally synchronously with the downwardly moving tube while the welder and folder are in contact with the tube and thereafter opening the welder and folder and shifting the welder and folder back upward and discharging the filled section from the lifter and displacing the lifter downward relative to the welder and folder.

2. The bag forming, filling and sealing machine according to claim 1 wherein the welder produces an upper and a lower weld seam.

3. The bag forming, filling and sealing machine according to claim 1 wherein the welder includes a welding device for the formation of an upper cross weld seam and a welding device for the formation of a lower cross weld seam.

4. The bag forming, filling and sealing machine according to claim 3 wherein the folder is formed by the welding device for the formation of the upper cross weld seam.

5. The bag forming, filling and sealing machine according to claim 1 wherein the folder is fixed relative to the welder.

6. The bag forming, filling and sealing machine according to claim 1 wherein the folder is formed by the welder.

7. The bag forming, filling and sealing machine according to claim 1, further comprising a single lowering device for the welder, folder and lifter.

8. The bag forming, filling and sealing machine according to claim 1, further comprising separate means for lowering the welder and the folder on the one side and of the lifter on the other side.

9. The bag forming, filling and sealing machine according to claim 1, further comprising a lowering device formed as a first slide movable along a vertical rail and supporting the welder, folder and lifter.

10. The bag forming, filling and sealing machine according to claim 9 wherein the lifter includes a second slide movable along another vertical rail and the other rail is mounted on the first slide.

11. The bag forming, filling and sealing machine according to claim 10 wherein the lifter has two container halves that are open on the upper side and supported at a cross beam so that they can pivoted between an open and closed position, the cross beam being supported by the second slide of the lifter.

12. The bag forming, filling and sealing machine according to claim 1, wherein the folder includes a pair of side folders.

13. The bag forming, filling and sealing machine according to claim 1 wherein the folder is mounted on the welder in a height adjustable manner.

* * * * *